US009433281B1

(12) United States Patent
Barras

(10) Patent No.: US 9,433,281 B1
(45) Date of Patent: Sep. 6, 2016

(54) BATHTUB-SCRUBBING ACCESSORY

(71) Applicant: Sandra Barras, Dunkirk, NY (US)

(72) Inventor: Sandra Barras, Dunkirk, NY (US)

( * ) Notice: Subject to any disclaimer, the term of this patent is extended or adjusted under 35 U.S.C. 154(b) by 199 days.

(21) Appl. No.: 14/474,836

(22) Filed: Sep. 2, 2014

(51) Int. Cl.

| | |
|---|---|
| ***A47K 3/00*** | (2006.01) |
| ***A46B 11/06*** | (2006.01) |
| ***A47K 3/28*** | (2006.01) |
| ***A46B 11/00*** | (2006.01) |

(52) U.S. Cl.
CPC ..... *A46B 11/063* (2013.01); *A46B 11/0006* (2013.01); *A47K 3/001* (2013.01); *A47K 3/281* (2013.01)

(58) Field of Classification Search
CPC ..... A47K 3/001
USPC ..... 4/538–595
See application file for complete search history.

(56) References Cited

U.S. PATENT DOCUMENTS

| | | | | | |
|---|---|---|---|---|---|
| 3,593,707 | A * | 7/1971 | Pifer | A61C 17/0214 | 401/289 |
| 4,282,623 | A * | 8/1981 | Gacuzana | A46B 13/06 | 15/230.17 |
| 4,513,466 | A * | 4/1985 | Keddie | A46B 13/06 | 15/29 |
| 4,640,462 | A * | 2/1987 | Stearns, III | B05B 3/06 | 15/22.1 |
| 5,716,005 | A * | 2/1998 | McMahan | A46B 11/066 | 239/305 |
| 5,772,616 | A * | 6/1998 | Competiello | A61C 17/0214 | 285/8 |
| 5,913,982 | A * | 6/1999 | Phillips | B08B 1/04 | 134/6 |
| 6,058,543 | A * | 5/2000 | Thompson | A46B 11/06 | 15/29 |
| 6,213,667 | B1 * | 4/2001 | Isaac | A46B 11/063 | 401/282 |
| 6,336,764 | B1 * | 1/2002 | Liu | A46B 11/06 | 15/144.1 |
| D465,928 | S * | 11/2002 | Solivan | A46B 11/06 | D4/115 |
| 7,481,594 | B2 * | 1/2009 | Martin | A46B 11/0006 | 401/268 |
| 8,308,390 | B2 * | 11/2012 | Kao | A46B 11/0062 | 401/289 |
| 8,601,631 | B1 * | 12/2013 | Martin | A46B 13/04 | 15/29 |
| 2004/0047675 | A1 * | 3/2004 | Bonelli | A46B 11/063 | 401/289 |
| 2004/0117931 | A1 * | 6/2004 | Washington | A46B 13/008 | 15/29 |
| 2004/0118940 | A1 * | 6/2004 | Lavitt | A01G 25/145 | 239/302 |
| 2008/0045988 | A1 * | 2/2008 | Abbott | A61B 17/244 | 606/161 |
| 2008/0115302 | A1 * | 5/2008 | Kilkenny | A47L 13/254 | 15/104.94 |
| 2010/0143024 | A1 * | 6/2010 | Hurwitz | A01K 13/001 | 401/270 |
| 2010/0243086 | A1 * | 9/2010 | Gilpatrick | A01G 25/145 | 137/565.01 |
| 2011/0206445 | A1 * | 8/2011 | Hurwitz | A01K 13/001 | 401/282 |
| 2011/0225748 | A1 * | 9/2011 | Best | A46B 11/063 | 15/22.1 |
| 2012/0018540 | A1 * | 1/2012 | Gilpatrick | B05B 7/0408 | 239/526 |
| 2012/0076567 | A1 * | 3/2012 | Burhans | A47L 17/00 | 401/205 |
| 2012/0138088 | A1 * | 6/2012 | Tumale | A01K 13/001 | 134/6 |

* cited by examiner

*Primary Examiner* — Lori Baker
(74) *Attorney, Agent, or Firm* — Kyle A. Fletcher, Esq.

(57) ABSTRACT

The bathtub-scrubbing accessory includes an external hose configured to be attached to a water source whereby water flows through the external hose into a chamber contained in a handle. The water exits the handle at a scrubbing brush that is located at opposing end of a chamber provided in the handle. A user controllable apparatus spins the scrubbing brush enhancing its cleansing ability. The apparatus is comprised of on-off switch, electrical power source, electric motor, and associated wires. The bath and shower cleaning device is an attachment for use with bathtub faucets for cleaning bathtubs and showers.

12 Claims, 4 Drawing Sheets

BATHTUB-SCRUBBING ACCESSORY

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of accessories for bathtubs, more specifically, a device configured to attach to a faucet, and which is able to scrub a corresponding bathtub.

SUMMARY OF THE INVENTION

An embodiment of the disclosure meets the needs presented above by generally comprising an external hose configured to be attached to a water source whereby water flows through the external hose into a chamber contained in a handle. The water exits the handle at a scrubbing brush that is located at opposing end of a chamber provided in the handle. A user controllable apparatus spins the scrubbing brush enhancing its cleansing ability. The apparatus is comprised of on-off switch, electrical power source, electric motor, and associated wires. The bath and shower cleaning device is an attachment for use with bathtub faucets for cleaning bathtubs and showers.

These together with additional objects, features and advantages of the bathtub-scrubbing accessory will be readily apparent to those of ordinary skill in the art upon reading the following detailed description of presently preferred, but nonetheless illustrative, embodiments of the bathtub-scrubbing accessory when taken in conjunction with the accompanying drawings.

In this respect, before explaining the current embodiments of the bathtub-scrubbing accessory in detail, it is to be understood that the bathtub-scrubbing accessory is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the bathtub-scrubbing accessory.

It is therefore important that the claims be regarded as including such equivalent construction insofar as they do not depart from the spirit and scope of the bathtub-scrubbing accessory. It is also to be understood that the phraseology and terminology employed herein are for purposes of description and should not be regarded as limiting.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

Figure 1:
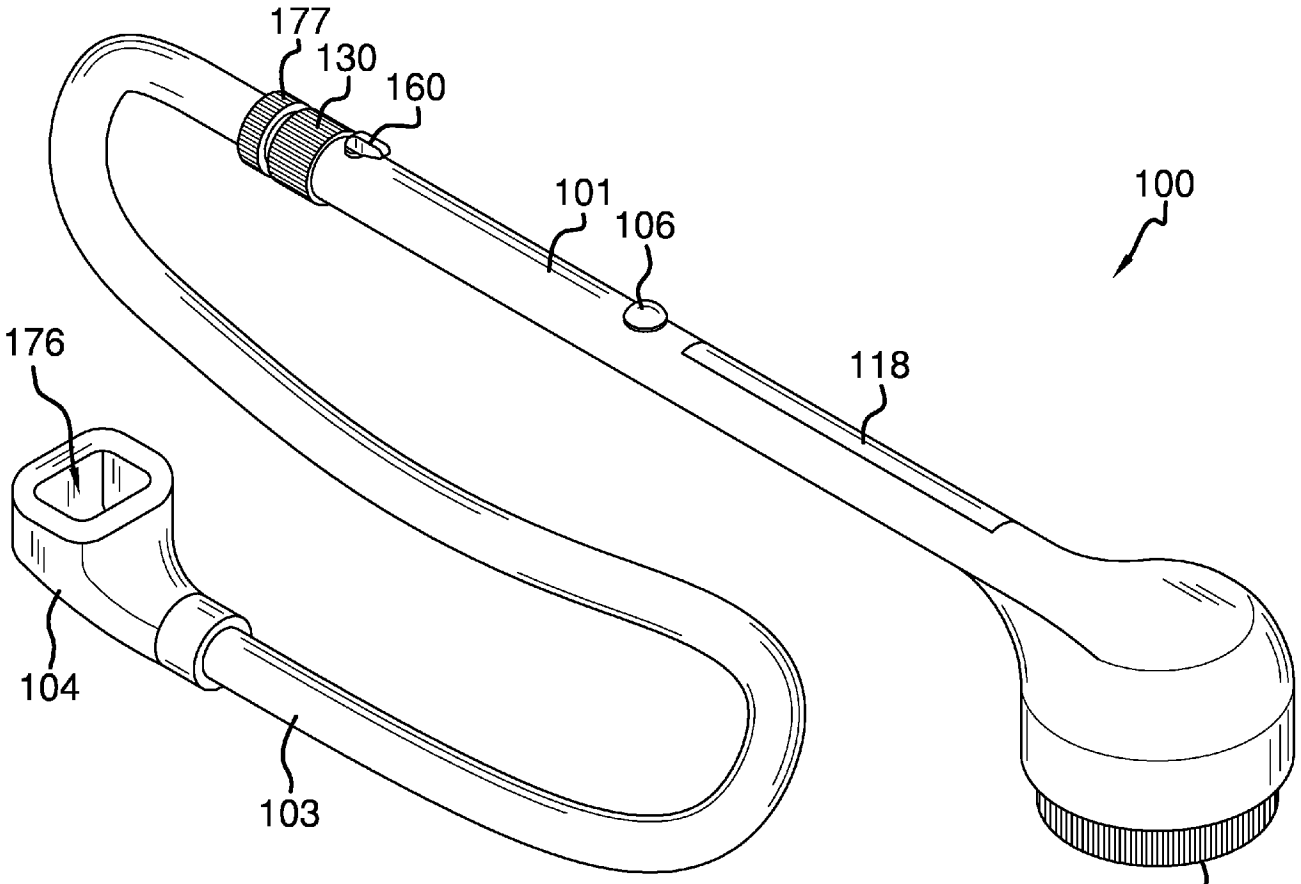
FIG. 1 is a perspective view of an embodiment of the disclosure.
Figure 2:
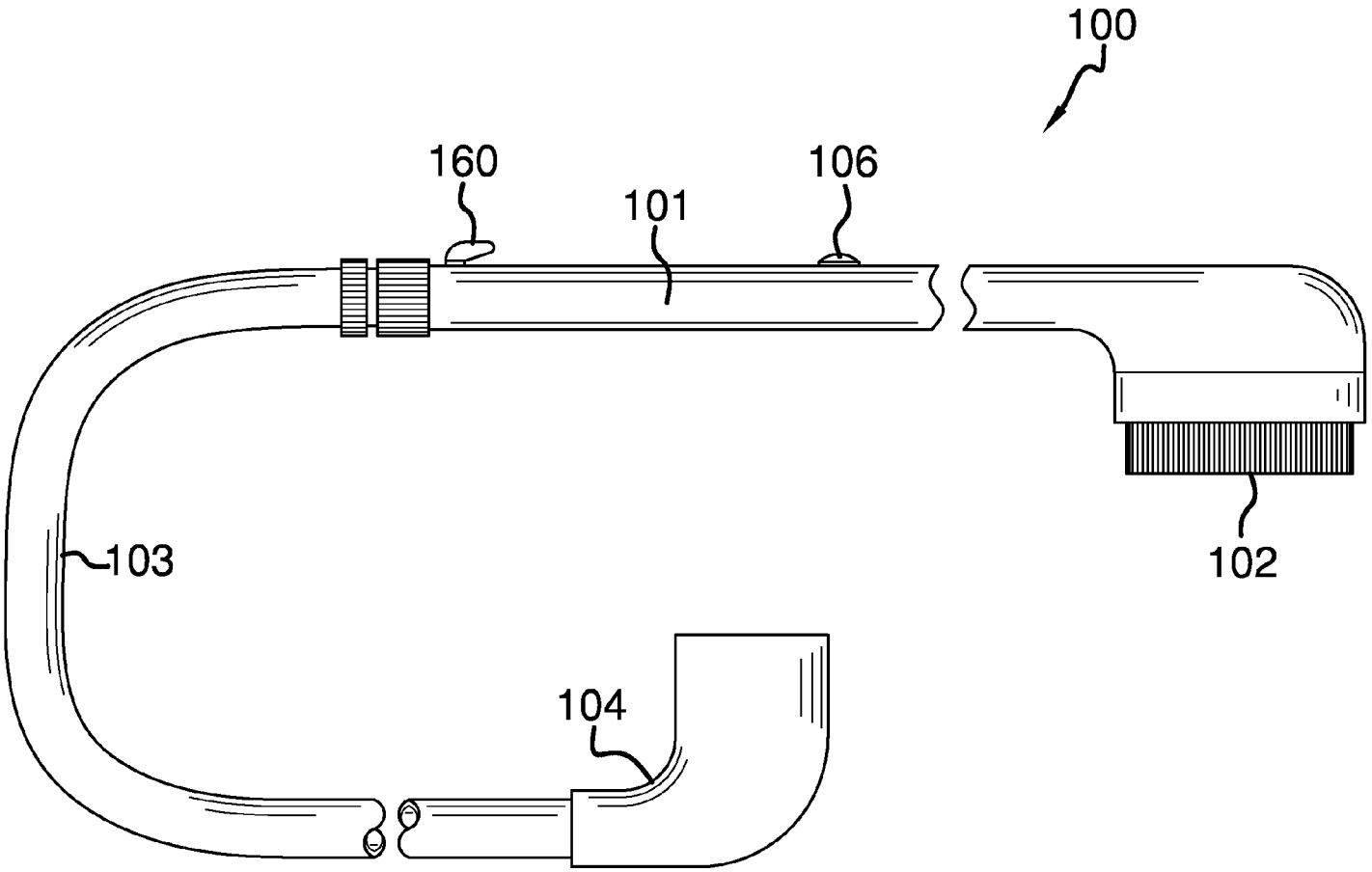
FIG. 2 is a front view of an embodiment of the disclosure.
Figure 3:
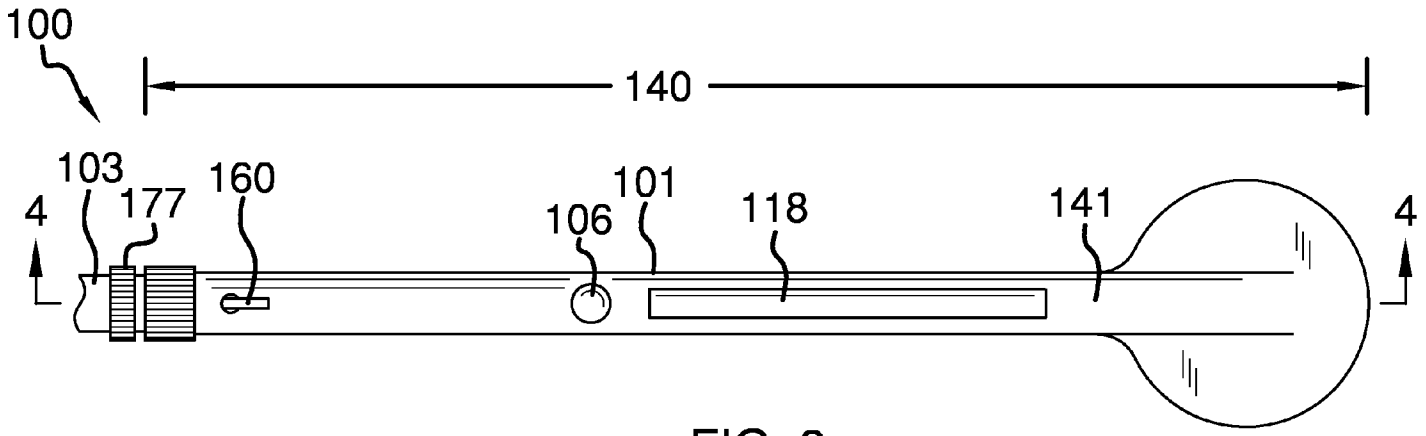
FIG. 3 is a top view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

As best illustrated in FIGS. 1 through 5, the bathtub-scrubbing accessory 100 (hereinafter invention) generally comprises a handle 101, a scrubbing brush 102, an external hose 103 and a faucet connector 104.

Figure 4:
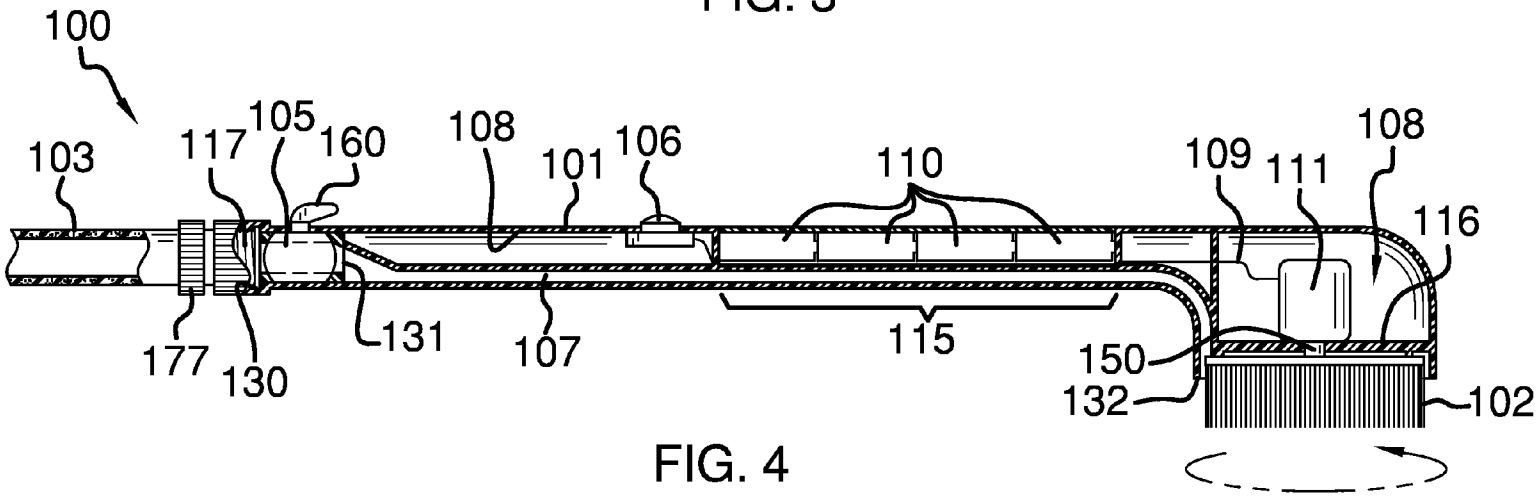
FIG. 4 is a cross-sectional view along line 4-4 in FIG. 3.
Figure 5:
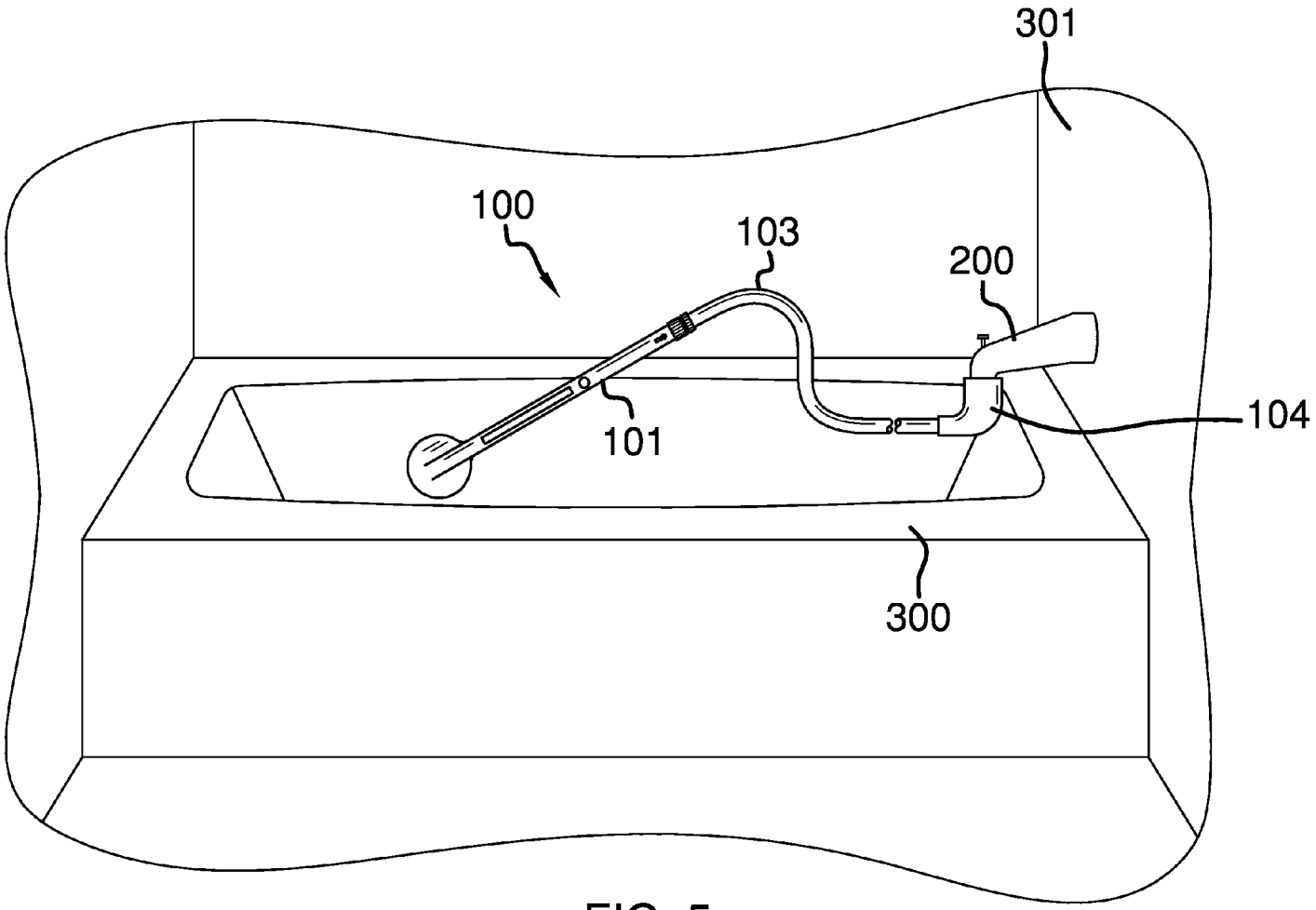
FIG. 5 is a view of an embodiment of the disclosure in use.

As shown in FIG. 4, the handle 101 is comprised of two segregated interior structures: the water channel 107 and the electrical chamber 108. The purpose of the water channel 107 is to route water from the external hose 103 to the scrubbing brush 102. The purpose of the electrical chamber 108 is to provide a housing for the apparatus required to spin the scrubbing brush 102.

The water channel 107 includes a valve 105 that is located adjacent to a first handle distal end 130. The valve 105 regulates water flow into a first end 131 of the water channel 107. That being said, the valve 105 is positioned in between the first handle distal end 130 and the first end 131 of the water channel 107. The water channel 107 is further defined with a second end 132. The second end 132 is adjacent to the scrubbing brush 102.

Water is provided from a faucet 200 that may be located adjacent a bathtub or shower. Water flows into the faucet connector 104 into the external hose 103 through the handle 101 and across the valve 105 and down the water channel 107. The valve 105 includes a valve armature 160 that rotates to open and close off the valve 105. The water is then released next to the scrubbing brush 102 providing a continuous stream of water for cleaning.

Inside the electrical chamber 108 is mounted an apparatus that is comprised of a waterproof bushing 116, an electric motor 111, at least one battery 110, a battery compartment 115, an on-off switch 106, and wiring 109. The at least one battery 110 is mounted and contained within the battery compartment 115. Moreover, the at least one battery 110 is used to supply electrical power to the electric motor 111. The at least one battery 115 is wired in series with the on-off switch 106 and the electric motor 111. It shall be noted that the electrical chamber 108 spans a majority of a handle length 140. Moreover, the electrical chamber 108 encompasses the battery compartment 115.

When the on-off switch 106 is turned "on," electricity from the batteries 110 flows to the electric motor 111 turning a drive shaft 150 mounted through the waterproof bushing 116. The drive shaft 150 is affixed to the scrubbing brush 102, and is responsible for providing rotational movement of the scrubbing brush 102. A battery compartment door 118 is mounted on a top handle surface 141 of the handle 101, which allows access to the battery compartment 115, and more importantly, for installing and changing batteries 110.

The scrubbing brush 102 is a bristled cleaning brush that can be used to remove dirt from a bathtub 300 and/or a shower wall 301. The scrubbing brush 102 can be used manually or, when extra cleaning is required, the electric motor 111 can be turned on which rotates the scrubbing brush 102 providing additional cleaning actions.

The external hose 103 is connected to the handle 101 using a plumbing connection 117. The plumbing connection 117 is threadably attached to the first handle distal end 130 of the handle 101. The plumbing connection 117 may include a rotatable collar 177, which enables the plumbing connection 117 to rotate with respect to the external hose 103.

The faucet connector 104 is affixed to the external hose 103 using a second plumbing connection 175. The second plumbing connection 175 is essentially a watertight fitting that ensures no water leak occurs between the faucet connector 104 and the external hose 103. The faucet connector 104 is affixed to the faucet 200 directly. The faucet connector 104 has a connector opening 176, which fits over the faucet 200 directly. Moreover, the faucet connector 104 is a made of a rubber, and which is flexible in order to form a snug watertight seal onto the faucet 200 when in use.

The handle 101 can be made of molded plastic forming the water channel 107 and the electrical chamber 108 with fittings for the valve 105, the on-off switch 106, the electric motor 111, the battery holder 115, and the battery compartment door 118. The handle 101 could also be made of PVC pipes and accessories including PVC end caps, PVC bushings, and PVC bends. Vinyl tubing could be used as the conduit and would be mounted inside the PVC pipe.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A bathtub-scrubbing accessory comprising:

an external hose connected to a handle and a faucet connector;

said faucet connector is configured to be secured to a faucet in order to deliver water to said handle;

a scrubbing brush is provided on said handle;

said scrubbing brush is able to spin in concert with water in order to be adapted for use in scrubbing a bathtub or shower wall surface;

wherein the handle is comprised of a water channel and an electrical chamber; wherein the water channel routes water from the external hose to the scrubbing brush; wherein the electrical chamber provides a housing for componentry used to spin and support the scrubbing brush;

wherein the water channel includes a valve that is located adjacent to a first handle distal end;

wherein the valve regulates water flow into a first end of the water channel; wherein the valve is positioned in between the first handle distal end and the first end of the water channel;

wherein the water channel is further defined with a second end;

wherein the second end is adjacent to the scrubbing brush;

wherein water flows into the faucet connector, into the external hose, through the handle, and across the valve, down the water channel, and is dispensed adjacent the scrubbing brush;

wherein the valve includes a valve armature that rotates to open and close off the valve.

2. The bathtub-scrubbing accessory according to claim 1 wherein the electrical chamber includes a waterproof bushing, an electric motor, at least one battery, a battery compartment, an on-off switch, and wiring.

3. The bathtub-scrubbing accessory according to claim 2 wherein the at least one battery is mounted and contained within the battery compartment; wherein the at least one battery is used to supply electrical power to the electric motor.

4. The bathtub-scrubbing accessory according to claim 3 wherein the at least one battery is wired in series with the on-off switch and the electric motor; wherein the electrical chamber spans a majority of a handle length; wherein the electrical chamber encompasses the battery compartment.

5. The bathtub-scrubbing accessory according to claim 4 wherein the on-off switch regulates electricity from the batteries to the electric motor; wherein the electric motor turns a drive shaft mounted through the waterproof bushing; wherein the drive shaft is affixed to the scrubbing brush; wherein the electric motor provides rotational movement of the scrubbing brush.

6. The bathtub-scrubbing accessory according to claim 5 wherein a battery compartment door is mounted on a top handle surface of the handle, and allows access to the battery compartment; wherein the external hose is connected to the handle using a plumbing connection; wherein the plumbing connection is threadably attached to the first handle distal end of the handle.

7. The bathtub-scrubbing accessory according to claim 6 wherein the plumbing connection includes a rotatable collar, which enables the plumbing connection to rotate with respect to the external hose.

8. The bathtub-scrubbing accessory according to claim 6 wherein the faucet connector is affixed to the external hose using a second plumbing connection; wherein the second plumbing connection forms a watertight connection between the faucet connector and the external hose.

9. The bathtub-scrubbing accessory according to claim 8 wherein the faucet connector is configured to be affixed to the faucet directly; wherein the faucet connector has a connector opening, which fits over the faucet directly;

wherein the faucet connector is a made of a rubber, and which is flexible in order to form a snug watertight seal onto the faucet.

10. A bathtub-scrubbing accessory comprising:

an external hose connected to a handle and a faucet connector;

said faucet connector is configured to be secured to a faucet in order to deliver water to said handle;

a scrubbing brush is provided on said handle;

said scrubbing brush is able to spin in concert with water in order to be adapted for use in scrubbing a bathtub or shower wall surface;

wherein the handle is comprised of a water channel and an electrical chamber; wherein the water channel routes water from the external hose to the scrubbing brush; wherein the electrical chamber provides a housing for componentry used to spin and support the scrubbing brush;

wherein the water channel includes a valve that is located adjacent to a first handle distal end;

wherein the valve regulates water flow into a first end of the water channel;

wherein the valve is positioned in between the first handle distal end and the first end of the water channel;

wherein the water channel is further defined with a second end;

wherein the second end is adjacent to the scrubbing brush;

wherein water flows into the faucet connector, into the external hose, through the handle, and across the valve, down the water channel, and is dispensed adjacent the scrubbing brush;

wherein the valve includes a valve armature that rotates to open and close off the valve;

wherein the electrical chamber includes a waterproof bushing, an electric motor, at least one battery, a battery compartment, an on-off switch, and wiring.

11. The bathtub-scrubbing accessory according to claim 10 wherein the at least one battery is mounted and contained within the battery compartment; wherein the at least one battery is used to supply electrical power to the electric motor; wherein the at least one battery is wired in series with the on-off switch and the electric motor; wherein the electrical chamber spans a majority of a handle length; wherein the electrical chamber encompasses the battery compartment; wherein the on-off switch regulates electricity from the batteries to the electric motor; wherein the electric motor turns a drive shaft mounted through the waterproof bushing; wherein the drive shaft is affixed to the scrubbing brush; wherein the electric motor provides rotational movement of the scrubbing brush.

12. The bathtub-scrubbing accessory according to claim 11 wherein a battery compartment door is mounted on a top handle surface of the handle, and allows access to the battery compartment; wherein the external hose is connected to the handle using a plumbing connection; wherein the plumbing connection is threadably attached to the first handle distal end of the handle; wherein the plumbing connection includes a rotatable collar, which enables the plumbing connection to rotate with respect to the external hose; wherein the faucet connector is affixed to the external hose using a second plumbing connection; wherein the second plumbing connection forms a watertight connection between the faucet connector and the external hose; wherein the faucet connector is configured to be affixed to the faucet directly; wherein the faucet connector has a connector opening, which fits over the faucet directly; wherein the faucet connector is a made of a rubber, and which is flexible in order to form a snug watertight seal onto the faucet.

* * * * *